US006726145B1

(12) United States Patent
Kraus

(10) Patent No.: US 6,726,145 B1
(45) Date of Patent: Apr. 27, 2004

(54) PAPER TOWEL ROLL HOLDER WITH ADJUSTABLE PRESSURE MEMBER

(76) Inventor: Peter B. Kraus, 18115 NE. 92nd Ave., Battle Ground, WA (US) 98604

( * ) Notice: Subject to any disclaimer, the term of this patent is extended or adjusted under 35 U.S.C. 154(b) by 0 days.

(21) Appl. No.: 10/282,756

(22) Filed: Oct. 28, 2002

(51) Int. Cl.[7] ..... B65H 75/18
(52) U.S. Cl. ..... 242/597.7; 242/422.5
(58) Field of Search ..... 242/597.7, 422.5, 242/423, 423.1, 423.2, 597

(56) References Cited

U.S. PATENT DOCUMENTS

| | | | | | |
|---|---|---|---|---|---|
| 1,518,749 | A | * | 12/1924 | Nelson | 242/597.7 |
| 1,779,778 | A | * | 10/1930 | Nelson | 242/597.7 |
| D161,985 | S | | 2/1951 | Woodworth | |
| 2,752,106 | A | * | 6/1956 | Thompson | 242/422.5 |
| 2,917,249 | A | | 12/1959 | MacLelland | |
| 3,243,141 | A | * | 3/1966 | Cook et al. | 242/422.5 |
| 3,407,980 | A | * | 10/1968 | Addison | 242/422.5 |
| 3,477,656 | A | * | 11/1969 | Muller | 242/422.5 |
| 3,806,057 | A | | 4/1974 | Whatley | |
| 4,012,007 | A | | 3/1977 | Cunningham | |
| 4,030,676 | A | | 6/1977 | Bardsley | |
| 4,273,299 | A | * | 6/1981 | Ness | 242/423.1 |
| 4,487,376 | A | | 12/1984 | Compton | |
| 4,535,947 | A | | 8/1985 | Hidle | |
| 4,535,948 | A | | 8/1985 | Gillen | |
| 4,600,162 | A | | 7/1986 | Hidle | |
| 4,720,053 | A | * | 1/1988 | Vance | 242/423.2 |
| 4,741,486 | A | | 5/1988 | Ancona et al. | |
| D326,580 | S | | 6/1992 | Brazis | |
| 5,149,003 | A | | 9/1992 | Tharp | |
| 5,292,083 | A | | 3/1994 | Ridenour | |
| 5,297,750 | A | | 3/1994 | Hunt | |
| 5,311,986 | A | | 5/1994 | Putz | |
| 5,605,304 | A | | 2/1997 | Ahern | |
| 5,727,750 | A | | 3/1998 | Kelly | |
| 5,788,136 | A | * | 8/1998 | Othman | 242/597.7 |
| 5,878,976 | A | | 3/1999 | Duck | |
| 5,950,961 | A | | 9/1999 | Duck | |
| 6,216,920 | B1 | * | 4/2001 | Baggett | 242/422.5 |
| 6,467,717 | B1 | * | 10/2002 | Pedicano et al. | 242/422.5 |

OTHER PUBLICATIONS

Catalog, "Rue De France", p. 28, published before Sep. 5, 2001.
Catalog, "Crate&Barrel", p. 40, published before Sep. 5, 2001.
Catalog, "Touch of Class", p. 41, published before Sep. 5, 2001.
Catalog, "Expressions", p. 33, published before Sep. 5, 2001.

* cited by examiner

*Primary Examiner*—William A. Rivera
(74) *Attorney, Agent, or Firm*—Kurt M. Rylander

(57) ABSTRACT

The roll holder with adjustable pressure member of the present invention provides an apparatus and method for preventing unraveling of the roll, in addition to providing all the typical functions of roll dispensers. The roll holder with adjustable pressure member includes a base, an upright member connectable to the base and orthogonal thereto, and a pressure member wherein the pressure member is bent in an L-shape to be parallel to the base in one portion, and be parallel to the upright member in the other portion. Optionally, a slide plate can be provided as well as a guide pin and nut.

13 Claims, 2 Drawing Sheets

PAPER TOWEL ROLL HOLDER WITH ADJUSTABLE PRESSURE MEMBER

FIELD OF THE INVENTION

The subject invention relates generally to holders for rolled sheet products including, particularly, to holders for retaining and dispensing sheets from a paper towel roll.

BACKGROUND

Devices for dispensing a conventional roll of paper towels are numerous and are well known consumer products.

In the most common commercially available dispenser, two arms are used to hold the ends of the roll. Such dispensers are wall or cabinet-mounted and comprise a horizontal flat base and spaced-apart arms extending outward from opposite ends of the base, which clasp the ends of the roll, providing pivot points for the roll.

The arms of different dispensers accommodate receipt of paper towels in roll form in different ways. One typical commercially available dispenser has an arm or arms that pivot outward to receive a towel roll, and then pivot inward to capture the roll's center core tube, with ends of the arms having cylindrical lugs that fit into the core tube of the towel roll, thereby providing short rotation points about which the roll can rotate. Another approach teaches the incorporation of spring biased lugs mounted into the ends of the dispenser arms, rather than having the arms themselves pivot. The lugs recess into the arms as the towel roll is inserted there against and, when the roll is at its final position, the lugs eject outwardly and into the roll's core tube. The roll can then rotate about the lugs as individual sheets are withdrawn.

Another common approach to dispensing rolls is to use a flat base upon which the roll stands up on its end, with some type of post or cylinder, attached to the base, which rises up through the roll core tube, providing support for the roll and a rotation point for the roll. This eliminates the need for two arms.

With existing paper towel dispensers, the problem exists that, with toweling in the dispenser, the roll spins freely, thereby dispensing too many sheets, causing unraveling, product waste, and frustration in the user. In the two-arm style of holder, the only thing impeding the spin of the roll is the friction between the core and arm's lugs and between the toweling itself and the arms. In the base-and-post style of dispenser, the only thing impeding unraveling of the roll is the weight of the roll itself and its friction against the base.

With all types of dispensers, the unraveling problem is further exacerbated as the roll gets used, and the diameter of the roll reduces: either the ends of the roll exert less and less pressure and, hence, friction laterally against the holder's arms, or, in the base-and-post style, the decreased weight of the roll decreases friction against the flat base.

Some commercially available dispensers have an additional feature or features that facilitate tearing off sheets of toweling. In the base-and-post style of dispenser, an additional post, parallel to the roll core tube, is used to provide a fulcrum against which the toweling sheet can be torn. Unfortunately, this tearing post provides no solution to the unraveling problems described.

Presently known art attempts to address this problem, but has not completely solved the problem. The following represents a list of known related art:

The following represents a list of known related art:

U.S. Pat. No. 4,487,376 issued to Compton, Dec. 11, 1984;

U.S. Pat. No. 5,297,750 issued to Hunt, May 29, 1994;

U.S. Pat. No. 5,605,304 issued to Ahern, Feb. 25, 1997;

U.S. Pat. No. 4,030,676 issued to Bardsley, Jun. 21, 1977;

U.S. Design Pat. No. 161,985 issued to Woodworth, Feb. 13, 1951;

U.S. Pat. No. 4,012,007 issued to Cunningham, Mar. 5, 1977;

U.S. Design Pat. No. 326,580 issued to Brazis, Jun. 2, 1992;

U.S. Pat. No. 5,149,003 issued to Tharp, Sep. 22, 1992;

U.S. Pat. No. 5,727,750 issued to Kelly, Mar. 17, 1998;

U.S. Pat. No. 5,311,986 issued to Putz, May 17, 1994;

U.S. Pat. No. 5,292,083 issued to Ridenour, Mar. 8, 1994;

U.S. Pat. No. 5,878,976 issued to Duck, Mar. 9, 1999;

U.S. Pat. No. 5,950,961 issued to Duck, Sep. 14, 1999;

U.S. Pat. No. 4,741,486 issued to Ancona et al., May 3, 1988;

U.S. Pat. No. 4,600,162 issued to Hidle, Jul. 15, 1986;

U.S. Pat. No. 4,535,948 issued to Gillen, Aug. 20, 1985;

U.S. Pat. No. 4,535,947 issued to Hidle, Aug. 20, 1985;

U.S. Pat. No. 3,806,057 issued to Whatley, Apr. 23, 1974; and

U.S. Pat. No. 2,917,249 issued to MacLelland, Dec. 15, 1959.

The teachings of each of the above-listed citations (which does not itself incorporate essential material by reference) are herein incorporated by reference. None of the above inventions and patents, taken either singularly or in combination, is seen to describe the instant invention as claimed.

While the foregoing body of art indicates it to be well known to have a roll holder, the art described above does not teach or suggest a roll holder with adjustable pressure member which has the following combination of desirable features: (1) including: (1) prevention of a paper towel roll from unplanned or uncontrolled unraveling; (2) being able to keep the loose paper towel end of a conventional paper towel roll from flapping freely on a holder; (3) having an easily assembled and disassembled paper towel holder for ease of sale and/or storage; (4) having a paper towel holder that can be left freestanding on a horizontal countertop; and (5) a minimum of parts, readily available and inexpensive materials, so that production costs are minimized.

SUMMARY AND ADVANTAGES

The roll holder with adjustable pressure member of the present invention provides an apparatus and method for preventing unraveling of the roll, in addition to providing all the typical functions of roll dispensers. The roll holder with adjustable pressure member includes a base, an upright member connectable to the base, and a pressure member connectable to the base and engaging the upright member. Optionally, a slide plate can be provided as well as a guide pin and nut.

The paper towel roll holder with adjustable pressure member of the present invention presents numerous advantages, including: (1) prevention of a paper towel roll from unplanned or uncontrolled unraveling; (2) being able to keep the loose paper towel end of a conventional paper towel roll from flapping freely on a holder; (3) having an easily assembled and disassembled paper towel holder for ease of sale and/or storage; (4) having a paper towel holder that can be left freestanding on a horizontal countertop; and (5) a minimum of parts, readily available and inexpensive materials, so that production costs are minimized.

In the paper towel roll holder with adjustable pressure member, the roll to be dispensed is slid onto a center post, which is attached to a flat base. A pressure member is provided which presses against the roll, thereby preventing unraveling of the roll. The pressure member also provides a fulcrum against which the user can tear off sheets from the roll.

In its simplest form, the pressure member is a post or bar which rises parallel to the roll, alongside, and up against the outside of the roll, providing pressure against the roll and preventing unraveling. This pressure member curves underneath the roll, bending at approximately ninety degrees, and is attached to a plate or becomes an approximately flat surface upon which the roll spins. This plate section of the pressure member slides back and forth perpendicular to the axis of rotation of the roll, and can be adjusted by the user such that the pressure member presses against the outside of the roll.

The user can choose the distance from the pressure member to the center post and tighten the pressure member, so that it remains in place relative to the base and the center post. As the roll is used and its diameter decreases, the user can move the pressure member inward toward the center post and tighten it into a new position as desired.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

Figure 1:
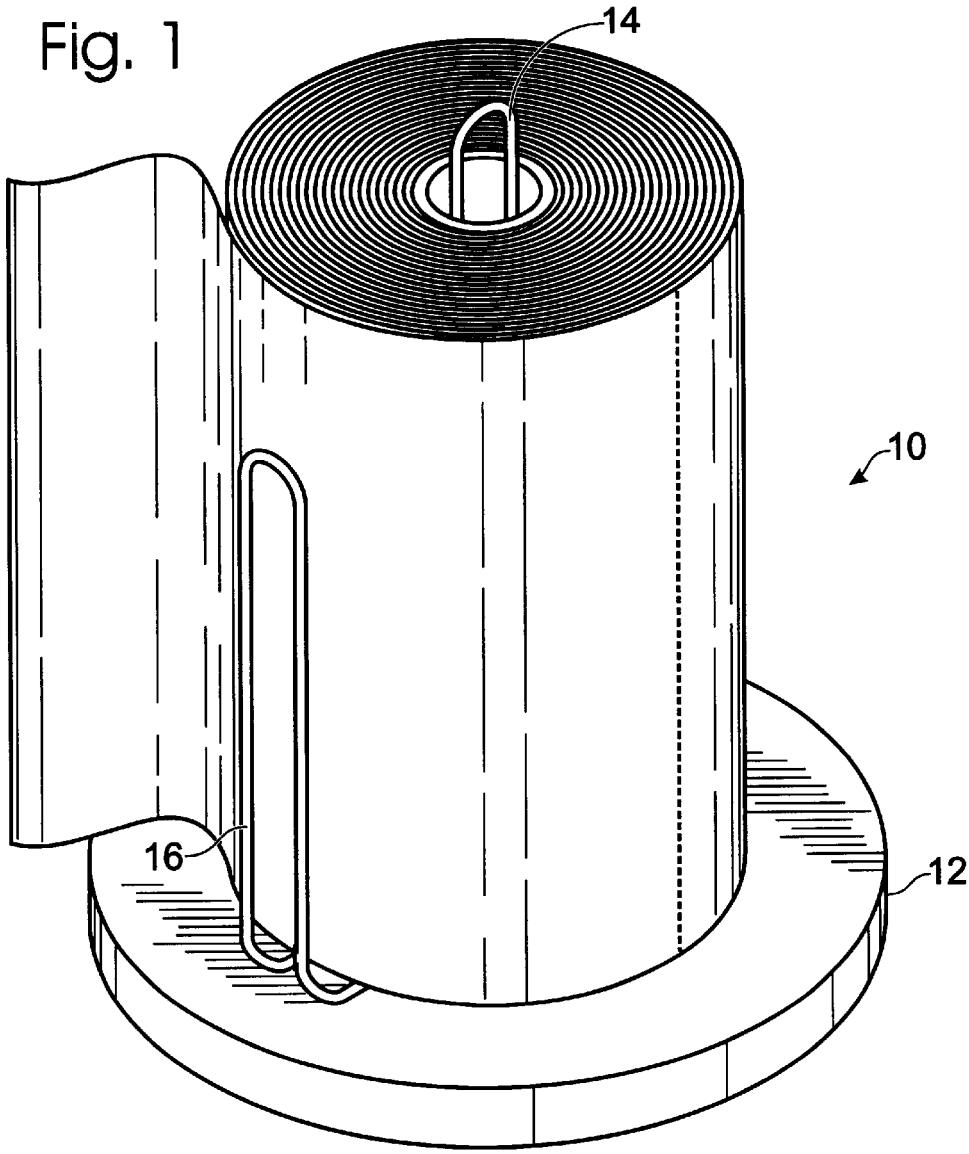
FIG. 1 shows an embodiment of the present invention with a paper towel roll placed for use.
Figure 3:
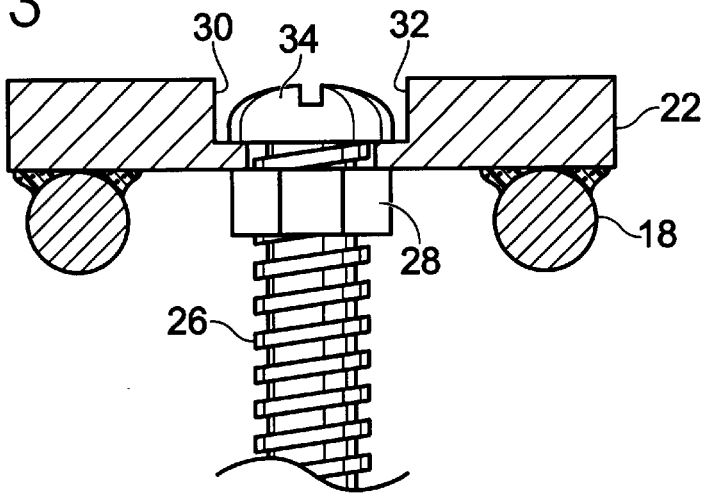
FIG. 3 shows an edge-on view of the sliding plate, guide pin, nut, and pressure member only.
Figure 2:
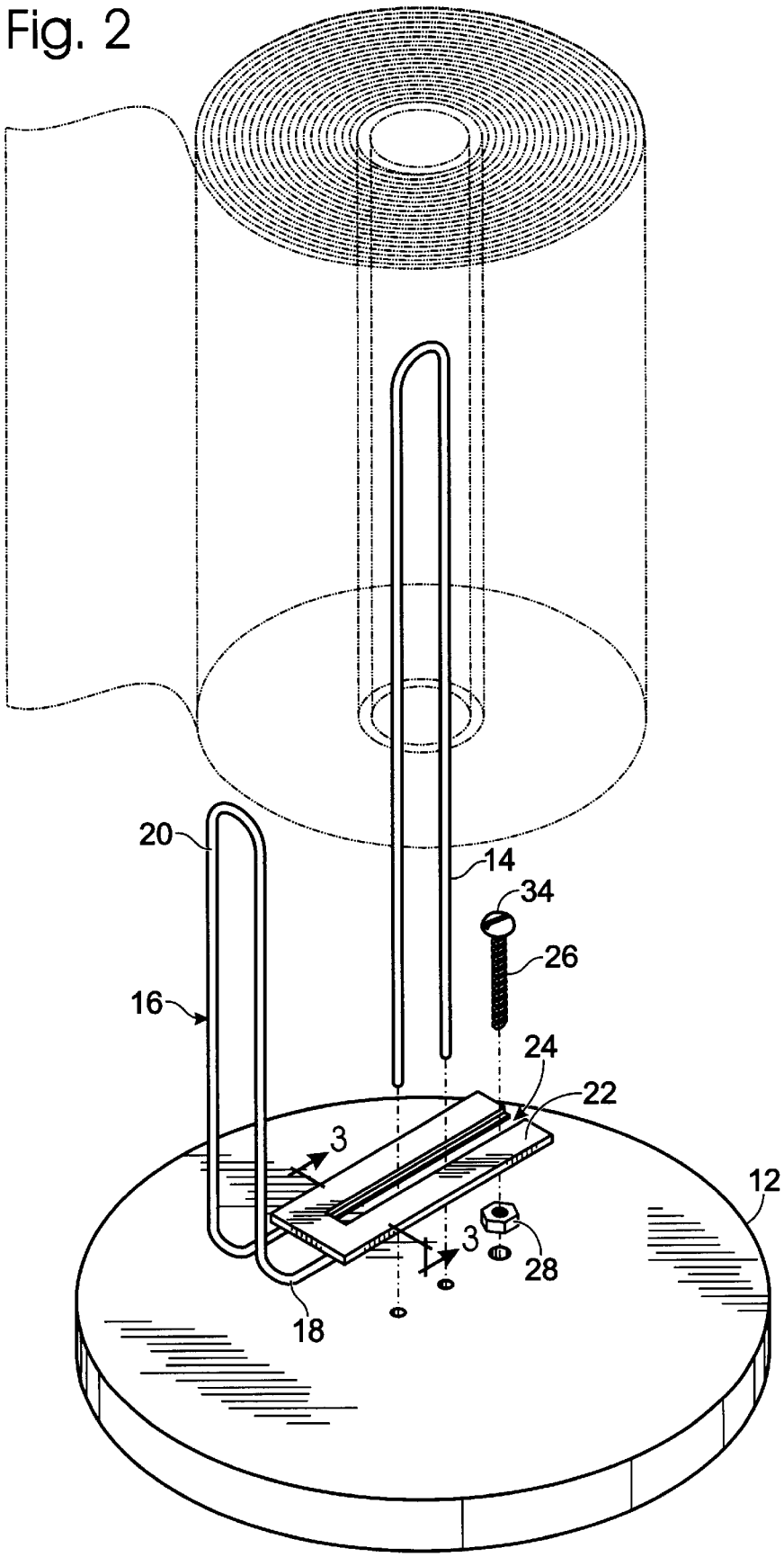
FIG. 2 shows an exploded view of the embodiment of the present invention shown in FIG. 1.

As shown in FIGS. 1–3, a roll holder with adjustable pressure member 10 is provided to hold a roll of wrapped material and to minimize and prevent unplanned unraveling of the roll. Roll holder with adjustable pressure member 10 comprises a base 12, an upright member 14 connectable to the base and orthogonal thereto, and a pressure member 16 connectable to the base and which is approximately parallel to the upright member at the upper end 20 of the pressure member, and engaging the upright member in the lower ends 18 of the pressure member. Optionally, a slide plate 22 can be provided as well as a guide pin 26 and nut 28.

FIG. 1 shows the first embodiment in use, with a roll of towels on the apparatus, ready for dispensing. Upright member 14, is attached to a flat base 12, perpendicular to the base, and rises through the center core of the roll. The base 12 can sit on a flat surface, such as a counter top. A pressure member 16 provides pressure against the outside of the roll; it wraps underneath the roll and rises parallel to the upright member 14.

FIG. 2 shows the roll holder with adjustable pressure member in use with a roll of towels ready for dispensation. In this view, the attachment and function of the pressure member 16 can be seen. The upright member 14 is shown as an elongated loop, closed at one end and open at the other. The open end of the upright member is secured into the base 12, approximately perpendicular to the base. The upright member loop has two equal, parallel lengths with the distance between the parallel lengths such that the upright member will fit inside the inner diameter of the roll core, allowing the roll to be slid down upon the upright member. It is recommended that the distance between parallel lengths be sufficiently wide such that there is only a small clearance between the roll core's inner diameter and the furthest outside distance of the parallel lengths of the upright member. In this fashion, when the roll is on the upright member, the will be minimal play between the roll core and the upright member. It is essential, however, that the roll core can rotate around the upright member on its center axis.

It is not essential that the upright member be constructed of a loop. Rather than using a loop or metal or other material, the upright member can be a cylinder of any rigid material, including wood, plastic, or metal, using the same guideline as to the outside diameter of the upright member.

In FIG. 2, the pressure member 16 is also shown as a loop closed at the upper end 20 and with free lower ends 18, and with two equal substantially parallel lengths. The pressure member is bent laterally at approximately a ninety-degree angle, approximately half-way down the length of the pressure members parallel lengths, forming an L-shaped curve. The lower ends 18 of the parallel lengths fit underneath the roll, roughly parallel to the upper surface of the base, while the upper end 20, is designed to press against the outer diameter of the roll. The upper end will then be substantially parallel to the upright member and provide the pressure function mentioned.

In the preferred embodiment, a slide plate 22 is permanently attached to the parallel lower ends of the pressure member. The slide plate is wide enough to span the distance between the parallel lower ends of the pressure member, and has a channel 24 cut into or formed in it. The slide plate can be made of any shape, including flat and circular, but is shown as flat rectangular piece in FIG. 2, and the channel is cut into it lengthwise. The channel 24 accommodates the upright member, allowing the combined slide plate and the lower ends of the pressure member to slide back and forth, perpendicular to the length of the upright member. With the channel formed in the slide plate, the slide plate takes on an elongated U-shape.

In this fashion, regardless of the diameter of the roll, the pressure member can be adjusted and slid into such a position that its upper end 20 press against the outside of the roll; and the pressure member can be readjusted and slid inward toward the upright member as the roll is used up and its diameter shrinks. At all times, the upper end of the pressure member will be substantially parallel to the upright member.

The position of the pressure member can be adjusted by the user and, in the preferred embodiment, temporarily fixed with respect to the base and upright member. In the preferred embodiment, this is accomplished using at least one guide pin 26 which is attached to the base, which passes through the channel on the slide plate, and which can be tightened against the slide plate by a threaded nut 28. The relative position of the guide pin is shown in FIG. 2, but it is not shown connected through the channel and the nut is not shown.

The guide pin 26 can be a commercially available carriage bolt, with the bolt head above the slide plate, and the end of the bolt attached to the base. The threaded nut 28 is screwed onto the guide pin, below the slide plate such that the nut may be tightened upward against the underside of the slide plate, causing the bolt head to press against the topside of the slide plate, and thereby holding the slide plate in place with respect to the base and upright member.

An alteration may be made to the slide plate, so that the head of the guide pin is recessed into the surface of the slide plate, so as to prevent the towel roll from catching on the guide pin head while turning. This can be done by cutting or forming two parallel cuts or depressions, parallel and adjacent to, along the sides of the channel, partially into the material of the slide plate, but not all the way through the material of the slide plate. A cross-section of the pressure member, slide plate and channel is shown in FIG. 3. The view in FIG. 3 is end-on of lower ends of the pressure member. These parallel cuts 30 and 32 alongside the channel for recessing the guide pin head 34 are shown, with the guide pin head recessed into the parallel cuts. FIG. 3 also shows the nut, tightened against the underside of the slide plate.

The nut used on the guide pin may be of the normal hexagonal construction, or, for greater ease of the user, may be replaced with a commonly available wing nut that can be more easily gripped and loosened and tightened.

The exact placement of the guide pin, exact size of the guide pin and nut, and exact configuration of the two are variable, as long as the general functionality is preserved. The guide pin and nut combination must allow the user to slide the pressure member into a proper position for pressure upon the outer diameter of the roll, the combination must temporarily hold the pressure member in that position, and then allow the user to alter the pressure member's position as needed to maintain pressure upon the outer diameter of the roll.

More than one guide pin and nut combination can be used to add greater stability and strength to the pressure member. A second combination can be placed on the other side of the base, opposite the original guide pin-nut combination. Using more than one combination allows the pressure member to be more firmly anchored with respect to the base and would support the pressure member off the base.

An alternate embodiment of the apparatus can be constructed by altering the construction of the pressure member. The pressure member can be made out of metal, wood, or plastic, so long as the basic shape described above is maintained, such that the functionality described above is maintained: the pressure member must be bent so as to provide pressure against the outer diameter of the towel roll, and bend down under the roll, have a channel cut into it to accommodate the upright member and at least one guide pin and nut combination, and allow sliding laterally to adjust the pressure against the roll's outer diameter. A second embodiment can be constructed meeting these guidelines, such as making the pressure member and slide plate a single, bent piece of plastic, metal, or wood that is bend at a ninety-degree angle and has a channel cut through the lower half.

Note also that the exact configuration of the upright member is not essential to the apparatus, so long as it can maintain its functionality of supporting a roll of towels, permanently attaching to the base, and allowing a roll to spin along its center axis. As noted previously, the upright member can be made out of wood, plastic or metal and may be roughly cylindrical in shape, but it may also be cut or formed so that, rather than being a true cylinder, it has two flattened sides, when viewed on-edge (i.e., down its center axis). Two flattened sides permit the upright member to be mated better with the channel in the pressure member, and might allow for superior sliding of the pressure member back and forth, perpendicular to the upright member's center axis.

In operation, a roll of material, preferably a paper towel roll, is placed on the roll holder by inserting the upright member through the central hollow core of the paper towel roll until the roll is against the pressure member slide plate. The pressure member is secured in position by tightening the guide pin and nut. Paper towels are dispensed by pulling on the end a sufficient length and then pulled against the pressure member to rip the unraveled paper towel length free. As the paper towel diameter is decreased through unraveling, the pressure member is slid inward to maintain contact with the paper towel roll by untightening the guide pin and nut, sliding the pressure member and slide plate in towards the paper towel roll, and retightening the guide pin and nut.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

I claim:

1. A paper towel roll holder with adjustable pressure member, comprising:

a. a base having a substantially flat underside surface which is adapted for use on a horizontal surface, and provided with a central aperture and at least one insertion hole in its top surface;

b. an upright member connectable to said base through said central aperture in said base and which can be inserted into a hollow core of a paper towel roll; and c. a pressure member connectable to the base and movably engageable with said upright member, wherein said pressure member is bent forming an L-shape, having a lower segment with a central channel, said channel's width sufficient so as to accommodate said upright member within its width and also sufficient such that said pressure member is capable of traveling back and forth in a perpendicular direction to, and around, said upright member.

2. A paper towel roll holder with adjustable pressure member, comprising:

a. a base having a substantially flat underside surface which is adapted for use on a horizontal surface, and provided with a central aperture and at least one insertion hole in its top surface;

b. an upright member of such a outer diameter to facilitate sliding within the inside diameter of a paper towel roll to be held and connectable at one end to said base at said central aperture;

c. at least one threaded bolt connectable to said base by insertion into said insertion hole;

d. at least one internally threaded nut that can be threadably attached to the threaded end of said bolt; and e. a pressure member, being bent at a ninety-degree angle, and having a lower segment with a central channel, said channel's width sufficient so as to be capable of accommodating said upright member and said bolt's threaded portion within its width and also sufficient such that said pressure member is capable of traveling back and forth in a perpendicular direction to, and around, said upright member, and said pressure member is further capable of being held in place relative to said base by said bolt and said nut combination.

3. A paper towel roll holder with adjustable pressure member, comprising:

a. a base having a substantially flat underside surface which is adapted for use on a horizontal surface, and provided with a central aperture and at least one insertion hole in its top surface;

b. an upright member connectable to said base through said central aperture in said base and which can be inserted into a hollow core of a paper towel roll;

c. at least one threaded bolt connectable to said base by insertion into said insertion hole, and at least one internally threaded nut that can be threadably attached to the threaded end of said bolt; and d. a pressure member connectable to the base and movably engageable with said upright member, wherein said pressure member is bent forming an L-shape, having a lower segment with a central channel, said channel's width sufficient so as to accommodate said upright member and said bolt's threaded portion within its width and also sufficient such that said pressure member is capable of traveling back and forth in a perpendicular direction to, and around, said upright member, and said pressure member is further capable of being held in place relative to said base by said bolt and said nut.

4. The roll holder with adjustable pressure member of claim 3, further comprising a slide plate connectable to said pressure member and engageable with said upright member.

5. The roll holder with adjustable pressure member of claim 4, further comprising a guide pin insertable through said base and said slide plate, and a nut screwable onto said guide pin.

6. The roll holder with adjustable pressure member of claim 1, wherein said upright member is friction fitted into said central aperture.

7. The roll holder with adjustable pressure member of claim 1, wherein said upright member is attached to said base by glue, nail, or screw.

8. The roll holder with adjustable pressure member of claim 1, wherein said base is wood.

9. The roll holder with adjustable pressure member of claim 1, wherein said base is metal.

10. The roll holder with adjustable pressure member of claim 1, wherein said base is plastic.

11. The roll holder with adjustable pressure member of claim 1, wherein said upright member is wood.

12. The roll holder with adjustable pressure member of claim 1, wherein said upright member is metal.

13. The roll holder with adjustable pressure member of claim 1, wherein said upright member is plastic.

* * * * *